US007909645B2

(12) United States Patent
Mulfinger et al.

(10) Patent No.: US 7,909,645 B2
(45) Date of Patent: Mar. 22, 2011

(54) COAXIAL CABLE CONNECTOR HOUSING

(75) Inventors: Robert Neil Mulfinger, York Haven, PA (US); Steven David Dunwoody, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/145,128

(22) Filed: Jun. 24, 2008

(65) Prior Publication Data

US 2009/0318018 A1 Dec. 24, 2009

(51) Int. Cl.
*H01R 9/05* (2006.01)

(52) U.S. Cl. ..... 439/578

(58) Field of Classification Search ..... 439/578, 439/582, 357–358, 581, 350–356
See application file for complete search history.

(56) References Cited

U.S. PATENT DOCUMENTS

| | | | | |
|---|---|---|---|---|
| 5,772,470 | A * | 6/1998 | Togashi | 439/582 |
| 6,074,217 | A | 6/2000 | Maruyama et al. | |
| 6,305,980 | B2 * | 10/2001 | Ko | 439/582 |
| 6,572,407 | B1 * | 6/2003 | Ko | 439/582 |
| 6,676,445 | B2 * | 1/2004 | Hall et al. | 439/582 |
| 6,790,082 | B2 | 9/2004 | Obayashi | |
| 7,021,966 | B2 | 4/2006 | Ikeda et al. | |

* cited by examiner

*Primary Examiner* — Jean F Duverne

(57) ABSTRACT

A housing is provided for a coaxial cable connector that terminates a coaxial cable. The housing includes a cable-receiving end portion configured to engage an insulating cover of the coaxial cable, a mating end portion configured to engage another coaxial connector, and a base extending between the cable-receiving end portion and the mating end portion. The base is configured to engage an outer electrical conductor of the coaxial cable. The housing also includes an electrical contact. The electrical contact includes an extension extending outwardly from the electrical contact, wherein the extension is configured to engage the outer electrical conductor of the coaxial cable.

17 Claims, 7 Drawing Sheets

COAXIAL CABLE CONNECTOR HOUSING

BACKGROUND OF THE INVENTION

The subject matter described and/or illustrated herein relates generally to electrical connectors for coaxial cables, and more particularly, to electrically conductive housings of coaxial cable connectors.

Due to their favorable electrical characteristics, coaxial cables and connectors have grown in popularity for interconnecting electronic devices and peripheral systems. Coaxial cable connectors typically include an inner electrical contact coaxially disposed within an outer electrical contact of an electrically conductive housing, with a dielectric material separating the inner electrical contact and the outer electrical contact. The inner electrical contact terminates the end of an inner electrical conductor of the coaxial cable, while the electrically conductive housing terminates an outer electrical conductor of the coaxial cable that is coaxial with the inner electrical conductor. The outer electrical conductor of the coaxial cable and the housing of the coaxial cable connector typically serve as the ground path.

However, the geometry of the housing of at least some known coaxial cable connectors may require multiple crimping operations to complete termination of the coaxial cable to the coaxial cable connector. For example, multiple crimping operations may be used to crimp ground tabs to the outer electrical conductor of the coaxial cable and to crimp retention tabs that hold the outer electrical contact in position relative to a base of the housing. Moreover, in at least some known coaxial cable connectors, a portion of the end of the outer electrical conductor of the coaxial cable that extends past the ground tabs is exposed about the entirety of the circumference of the end portion except the portion of the circumference that is engaged by the base. The portion of the end that is exposed may emit electromagnetic interference (EMI).

There is a need for a coaxial cable connector that enables a coaxial cable to be terminated to the coaxial cable connector with fewer operations and/or that provides better EMI protection than at least some known coaxial cable connectors.

BRIEF DESCRIPTION OF THE INVENTION

In one embodiment, a housing is provided for a coaxial cable connector that terminates a coaxial cable. The housing includes a cable-receiving end portion configured to engage an insulating cover of the coaxial cable, a mating end portion configured to engage another coaxial connector, and a base extending between the cable-receiving end portion and the mating end portion. The base is configured to engage an outer electrical conductor of the coaxial cable. The housing also includes an electrical contact. The electrical contact includes an extension extending outwardly from the electrical contact, wherein the extension is configured to engage the outer electrical conductor of the coaxial cable.

In another embodiment, an electrical connector is provided for terminating a coaxial cable. The electrical connector includes an electrically conductive housing including a cable-receiving end portion configured to engage an insulating cover of the coaxial cable, a mating end portion configured to engage another coaxial connector, and a base extending between the cable-receiving end portion and the mating end portion. The base is configured to engage an outer electrical conductor of the coaxial cable. The housing also includes an outer electrical contact. The outer electrical contact defines a receptacle and includes an extension extending outwardly from the outer electrical contact. The extension is configured to engage the outer electrical conductor of the coaxial cable. The electrical connector also includes an insulating member held by the housing at least partially within the receptacle defined by the outer electrical contact, and an inner electrical contact held by the insulating member.

In another embodiment, a housing is provided for a coaxial cable connector that terminates a coaxial cable. The housing includes a cable-receiving end portion configured to engage an insulating cover of the coaxial cable, a mating end portion configured to engage another coaxial connector, and a base extending between the cable-receiving end portion and the mating end portion. The base is configured to engage an outer electrical conductor of the coaxial cable. The housing also includes an electrical contact that extends outwardly from the base. The electrical contact includes an extension. The housing also includes a retention tab extending outwardly from the base. The retention tab is configured to wrap around a portion of the extension such that the retention tab is configured to hold the extension between a portion of the retention tab and a portion of the base. The retention tab is configured to engage the outer electrical conductor of the coaxial cable.

DETAILED DESCRIPTION OF THE INVENTION

Figure 1:
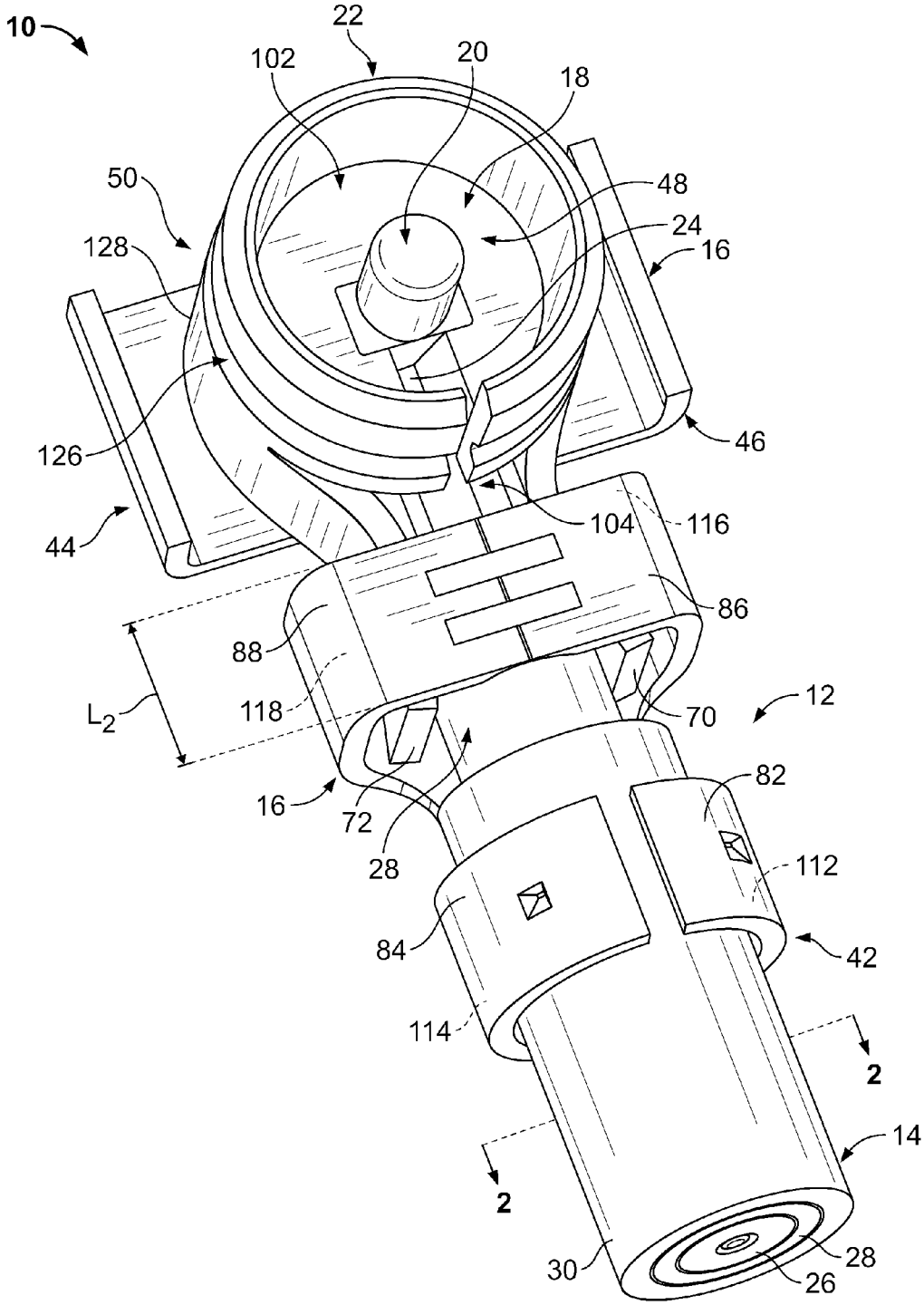
FIG. 1 is a perspective view of an exemplary embodiment of an electrical connector illustrating the electrical connector terminating the end of a coaxial cable.

FIG. 1 is a perspective view of an exemplary embodiment of an electrical connector 10 illustrating the electrical connector 10 terminating the end 12 of a coaxial cable 14. The electrical connector 10 includes an electrically conductive housing 16, an insulating member 18 held by the housing 16, and an inner electrical contact 20 held by the insulating member 18. In the exemplary embodiment, the inner electrical contact 20 is a plug contact, which is sometimes referred to as a "pin contact". The housing 16 includes an outer electrical contact 22 that holds the insulating member 18. The outer electrical contact 22 is coaxial with the inner electrical contact 20 and is positioned radially outward from the inner electrical contact 20. The insulating member 18 electrically isolates the inner electrical contact 20 from the outer electrical contact 22 as well as other portions of the housing 16. The inner electrical contact 20 is configured to be received by a receptacle contact (such as, but not limited to, the receptacle contact 220 shown in FIGS. 9 and 10) of another electrical connector (such as, but not limited to, the electrical connector 210 shown in FIGS. 9 and 10) that is configured to mate with the electrical connector 10. Similarly, the outer electrical contact 22 is configured to engage an outer electrical contact (such as, but not limited to, the outer electrical contact 222 shown in FIGS. 9 and 10) of the other electrical connector. In some embodiments, the other electrical connector is mounted on a substrate, such as, but not limited to, a circuit board, a panel, and/or the like. In other embodiments, the other electrical connector terminates the end of another coaxial cable (not shown).

In the exemplary embodiment, the housing 16 is a ground path, while the inner electrical contact 20 is a signal path. Alternatively, the housing 16 is a signal path and the inner electrical contact 20 is a ground path. The electrical connector 10 may be any type of connector suitable for use with any type of coaxial cable; such connectors are sometimes referred to as "coaxial cable connectors". In the exemplary embodiment, the electrical connector 10 is an ultraminiature coax connector (UMCC).

Figure 2:
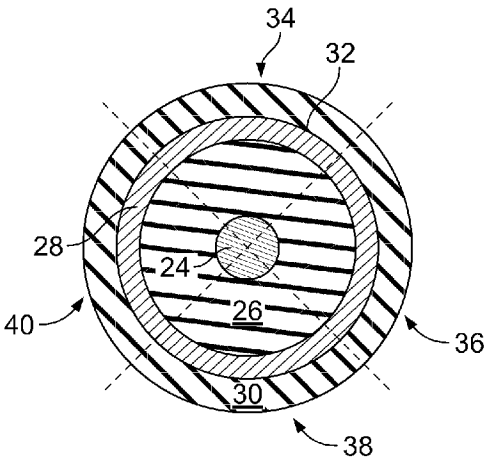
FIG. 2 is cross-sectional view of the coaxial cable shown in FIG. 1 taken along line 2-2 of FIG. 1.

FIG. 2 is cross-sectional view of the coaxial cable 14 taken along line 2-2 of FIG. 1. The coaxial cable 14 includes an inner electrical conductor 24, an insulating member 26 surrounding the inner electrical conductor 24, an outer electrical conductor 28 surrounding the insulating member 26, and an insulating cover 30 surrounding the outer electrical conductor 28. The inner electrical conductor 24, the insulating member 26, the outer electrical conductor 28, and the insulating cover 30 are coaxial, with the insulating member 26 positioned radially outward from the inner electrical conductor 24, the outer electrical conductor 28 positioned radially outward from the insulating member 26, and the insulating cover 30 positioned radially outward from the outer electrical conductor 28. The outer electrical conductor 28 includes a circumference 32 having four quadrants 34, 36, 38, and 40. Any of the quadrants 34, 36, 38, and 40 may be referred to herein as a "first quadrant" and/or a "second quadrant". In the exemplary embodiment, the inner electrical conductor 24 is a signal path while the outer electrical conductor 28 is a ground path. However, alternatively the inner electrical conductor 24 may be a ground path while the outer electrical conductor 28 is a signal path.

Figure 3:
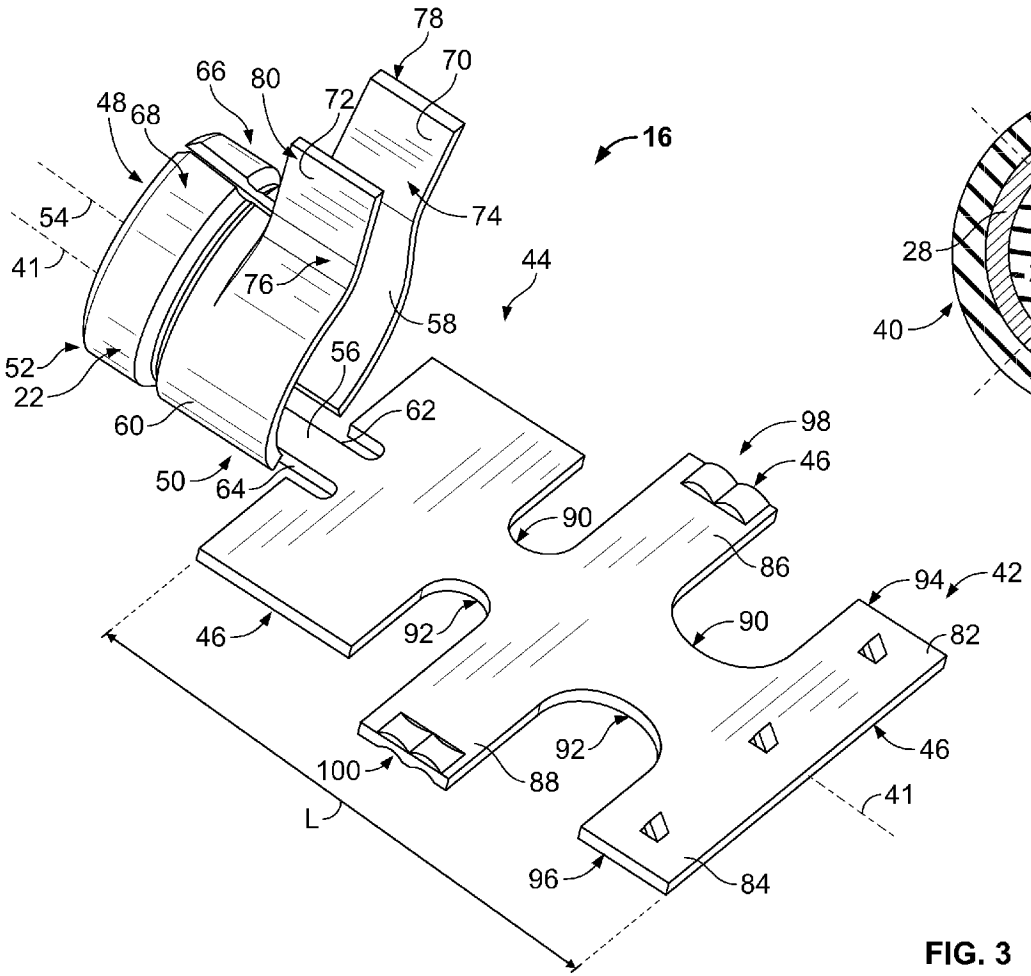
FIG. 3 is a perspective view of an exemplary embodiment of a housing of the electrical connector shown in FIG. 1 illustrating the housing as disassembled.
Figure 4:
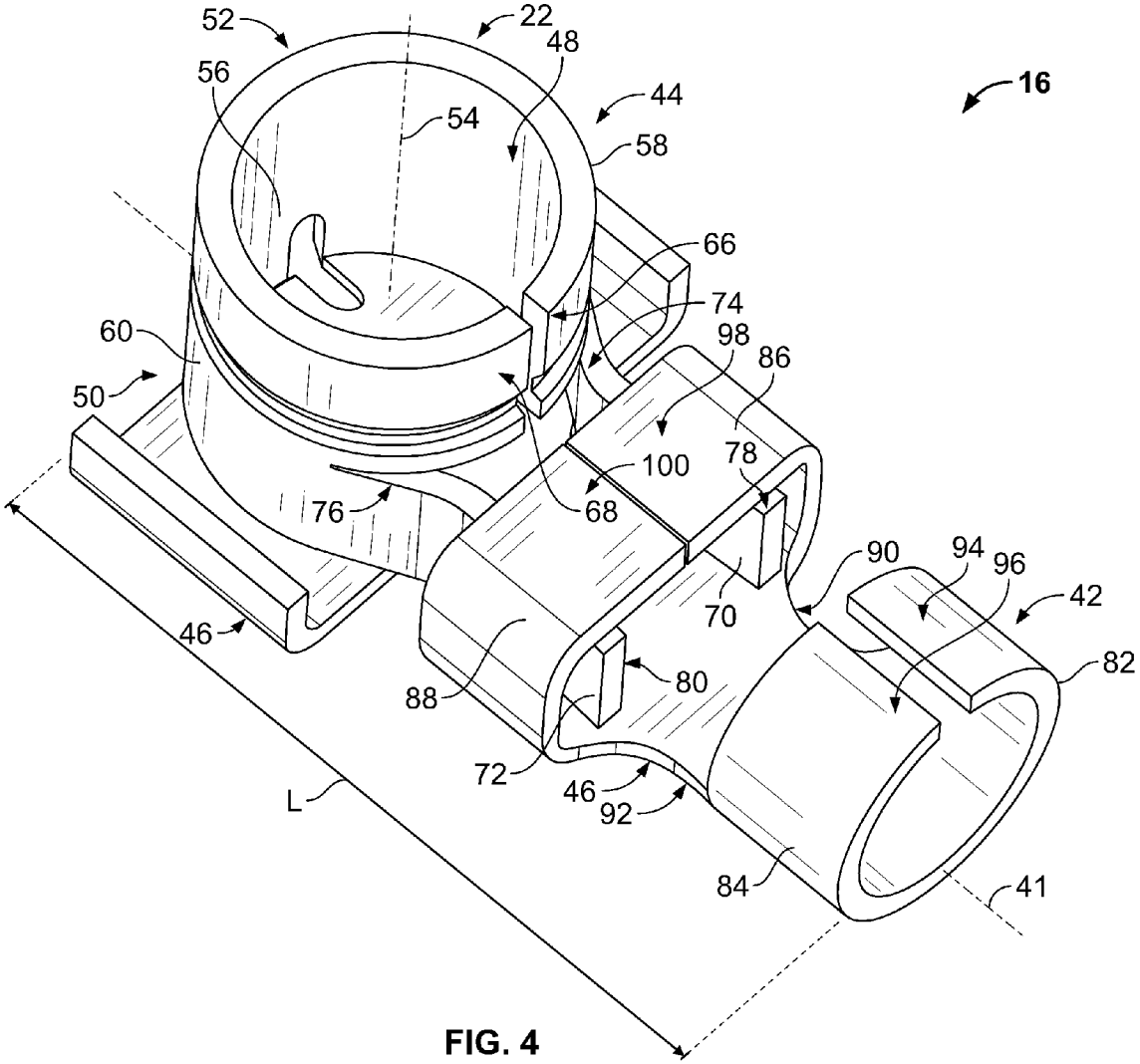
FIG. 4 is a perspective view of the housing shown in FIG. 3 illustrating the housing as assembled.

FIGS. 3 and 4 are perspective views of an exemplary embodiment of the housing 16 of the electrical connector 10 (FIGS. 1 and 5-7) illustrating the housing 16 as disassembled and assembled, respectively. The housing 16 extends a length L along a central longitudinal axis 41 between a cable-receiving end portion 42 and a mating end portion 44. The cable-receiving end portion 42 is configured to engage the insulating cover 30 (FIGS. 1, 2, and 5-7) of the coaxial cable 14. The mating end portion 44 is configured to engage the other electrical connector. In the exemplary embodiment, the outer electrical contact 22 is located at the mating end portion 44 of the housing 16. The housing 16 includes a base 46 that extends the length L along the central longitudinal axis 41 between the cable-receiving end portion 42 and the mating end portion 44. The outer electrical contact 22 defines a receptacle 48 and extends between a pair of opposite end portions 50 and 52 along a central longitudinal axis 54. In the exemplary embodiment, the outer electrical contact 22 is defined by an extension 56 that extends outwardly from the base 46 along the central longitudinal axis 41, and a pair of opposite walls 58 and 60 that extend outwardly from opposite side portions 62 and 64 of the extension 56 to respective end portions 66 and 68. The end portions 66 and 68 of the walls 58 and 60, respectively, oppose one another such that the extension 56 and the walls 58 and 60 define the receptacle 48. Alternatively, the receptacle 48 may be defined by only one wall (not shown) that extends from either of the side portions 62 or 64 to an end portion that opposes the other side portion 62 or 64. Moreover, the receptacle 48 may alternatively be defined by a continuous wall (not shown) that extends from both side portions 62 and 64. When the housing 16 is assembled as shown in FIGS. 1 and 4-8, the base 46, at the mating end portion 44, covers, or closes, the end portion 50 (which is open in the disassembled state shown in FIG. 3) of the outer electrical contact 22.

A pair of extensions 70 and 72 extends outwardly from the outer electrical contact 22. When the housing 16 is assembled as shown in FIGS. 1 and 4-8, the extensions 70 and 72 extend along the base 46 generally toward the cable-receiving end portion 42 of the housing 16. Each of the extensions 70 and 72 extends between a respective inner end portion 74 and 76 and a respective outer end portion 78 and 80. The extensions 70 and 72 are angled relative to each other such that the inner end portions 74 and 76 are closer together than the outer end portions 78 and 80. Accordingly, when the housing 16 is assembled as shown in FIGS. 1 and 4-8, the extensions 70 and 72 are each angled acutely relative to the central longitudinal axis 41. Despite the specific angles shown herein, the extensions 70 and 72 may each be angled at any oblique and acute angle relative to the central longitudinal axis 41 and may be angled relative to each other at any angle that is less than 180° and greater than 0°. Although one extension 70 and one extension 72 are shown, the radially outer electrical connector 22 may include any number of extensions 70 and/or 72 extending therefrom.

The base 46 of the housing 16 includes a pair of opposite cover tabs 82 and 84 and a pair of opposite retention tabs 86 and 88. The cover tabs 82 and 84 extend outwardly from opposite side portions 90 and 92, respectively, of the base 46 to respective end portions 94 and 96. When the housing 16 is assembled as shown in FIGS. 1 and 4-8, the end portions 94 and 96 oppose one another. Alternatively, the base 46 may include only one cover tab (not shown) that extends from either of the side portions 90 or 92 to an end portion that opposes the other side portion 90 or 92. Moreover, the base 46 may alternatively include a continuous cover tab that extends from both side portions 90 and 92. Although one cover tab 82 and one cover tab 84 are shown, the base 46 may include any number of cover tabs 82 and/or 84 extending therefrom.

The retention tabs 86 and 88 extend outwardly from the opposite side portions 90 and 92, respectively, of the base 46 to respective end portions 98 and 100. When the housing 16 is assembled as shown in FIGS. 1 and 4-8, the end portions 98 and 100 oppose one another. Alternatively, the base 46 may include only one retention tab (not shown) that extends from either of the side portions 90 or 92 to an end portion that opposes the other side portion 90 or 92. Although one retention tab 86 and one retention tab 88 are shown, the base 46 may include any number of retention tabs 86 and/or 88 extending therefrom. When the housing 16 is assembled as shown in FIGS. 1 and 4-7, the retention tabs 86 and 88 of the base 46 wrap around, and engage, a portion of the extensions 70 and 72, respectively, such that the extensions 70 and 72 are held between a portion of the retention tabs 86 and 88, respectively, and a portion of the base 46. The retention tabs 86 and 88 facilitate retaining the outer electrical contact 22 in the position with respect to the base 46 that is shown in FIGS. 1 and 4-8.

The housing 16 may be fabricated using any suitable method, process, operation, structure, means, and/or the like that enables the housing 16 to function as described and/or illustrated herein. One example of fabricating the housing 16 comprises cutting and/or stamping the housing 16 out of a sheet of material. The housing 16 may optionally be fabricated such that prior to the assembly as shown in FIGS. 5, 6, and 2, the housing 16 is in the disassembled state shown in FIG. 3 but the walls 58 and 60 of the outer electrical contact 22 are not bent into the position shown in the FIG. 3, but rather lie in generally the same plane as the remainder of the housing 16 shown in FIG. 3.

Figure 6:
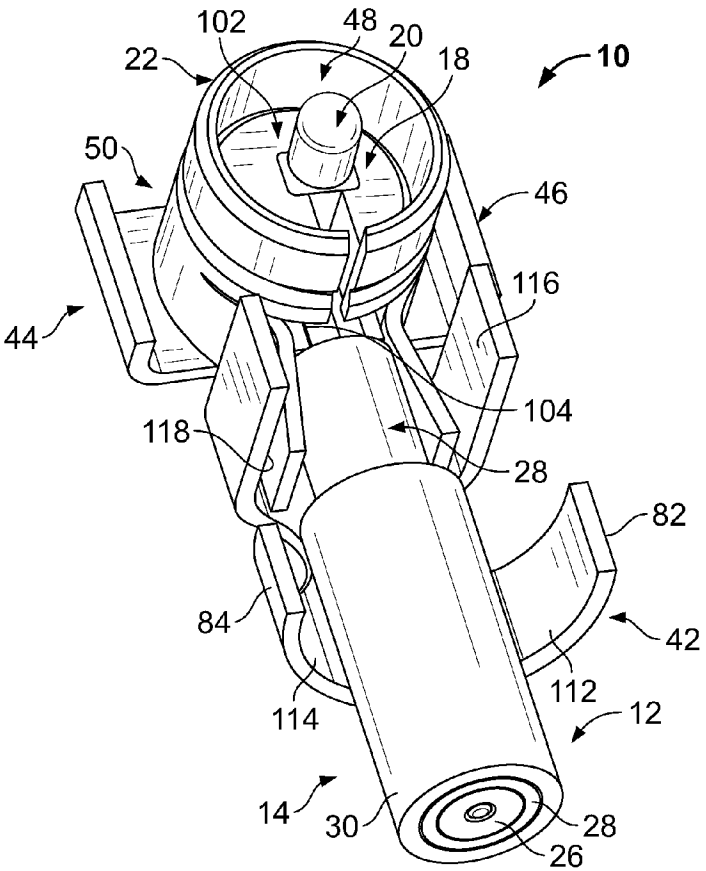
FIG. 6 is another partially exploded perspective view of the electrical connector and coaxial cable shown in FIG. 1 illustrating assembly of the electrical connector and the coaxial cable.
Figure 5:
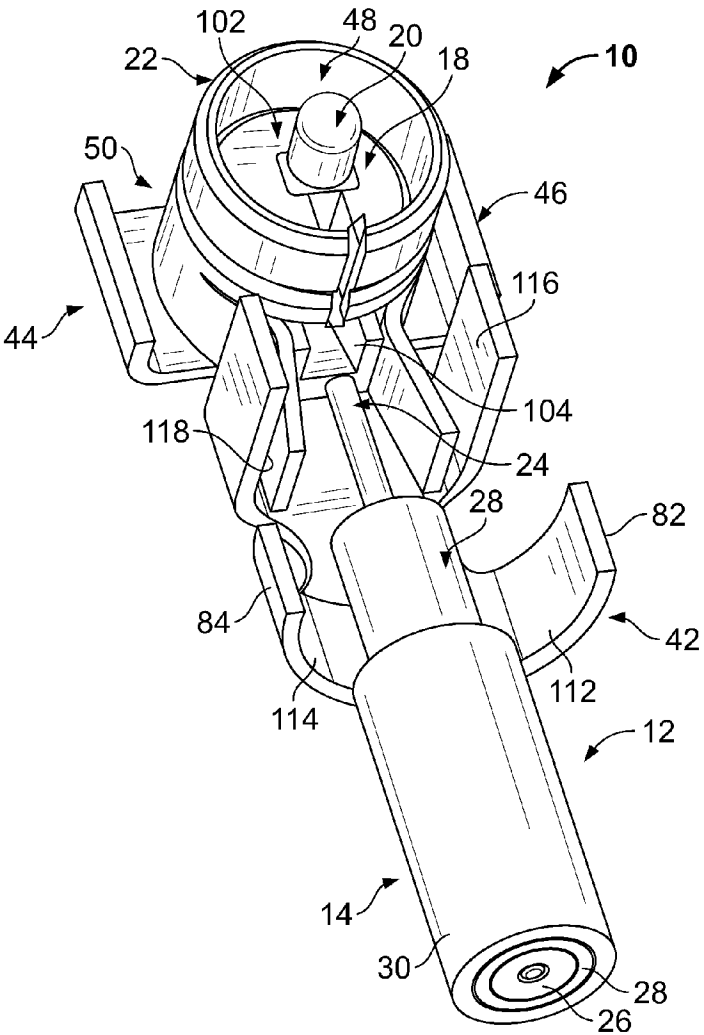
FIG. 5 is a partially exploded perspective view of the electrical connector and coaxial cable shown in FIG. 1 illustrating assembly of the electrical connector and the coaxial cable.
Figure 7:
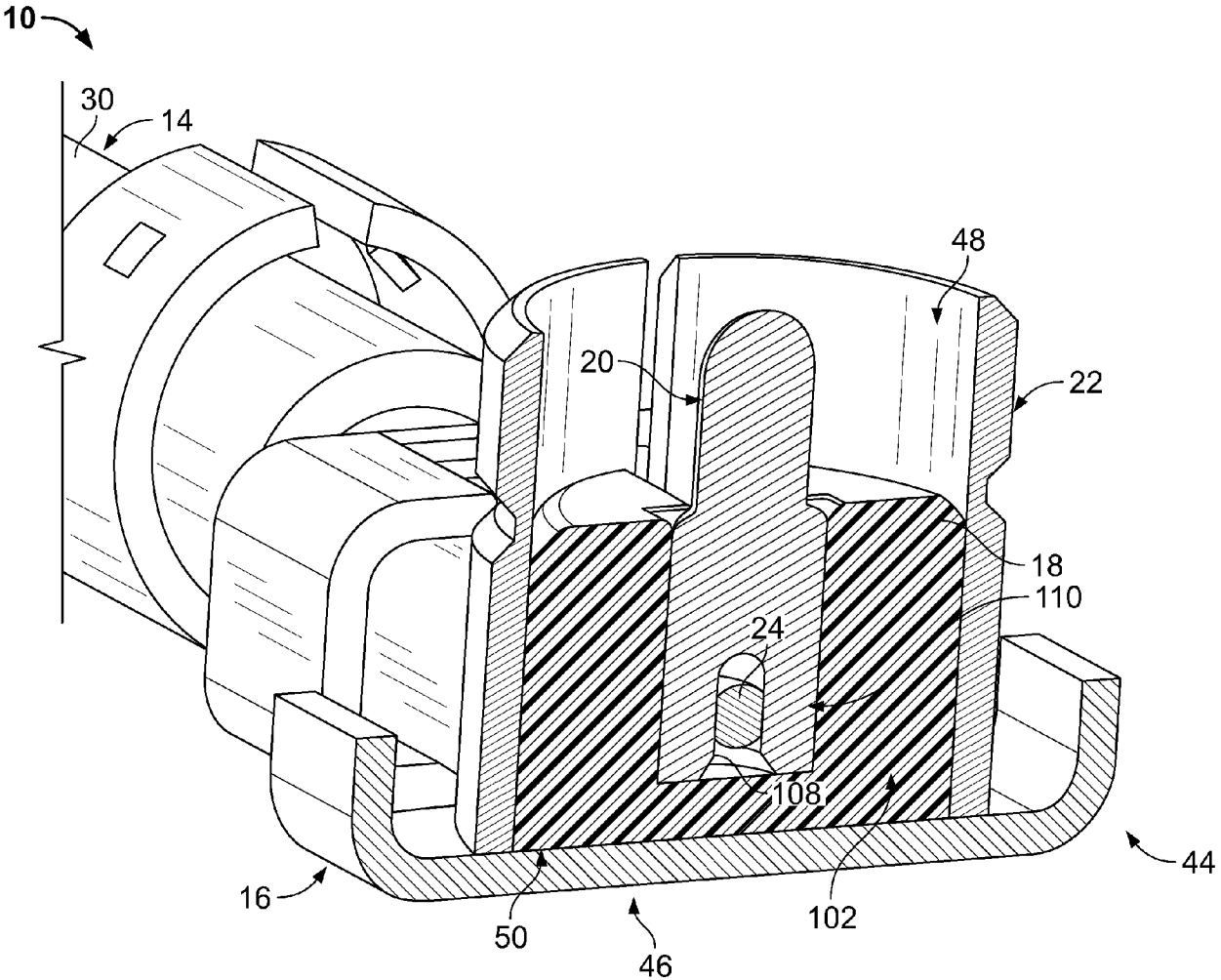
FIG. 7 is a partially broken-away perspective view of the electrical connector 10 and coaxial cable shown in FIG. 1 illustrating a cross section of a mating end portion of the electrical connector.

FIGS. 5 and 6 are partially exploded perspective views of the electrical connector 10 and the coaxial cable 14 illustrating assembly of the electrical connector 10 and the coaxial cable 14. FIG. 7 is a partially broken-away perspective view of the electrical connector 10 and the coaxial cable 14 illustrating a cross section of the mating end portion 44 of the electrical connector 10. Referring now to FIGS. 1 and 5-7, a portion 102 of the insulating member 18 of the electrical connector 10 is held within the receptacle 48 of the outer electrical contact 22. The insulating member 18 may be installed within the receptacle 48 when the housing 16 is disassembled as shown in FIG. 3. To position the outer electrical contact 22 as shown in FIGS. 1 and 4-7, the outer electrical contact 22 is rotated from the position shown in FIG. 3 toward the base 46 such that the base 46, at the mating end portion 44, covers, or closes, the end portion 50 (which is open in the disassembled state shown in FIG. 3) of the outer electrical contact 22.

At the end 12 of the coaxial cable 14, the outer electrical conductor 28 is exposed from the insulating cover 30 and the inner electrical conductor 24 is exposed from the insulating member 26 and the outer electrical conductor 28. The exposed portion of the inner electrical conductor 24 engages the inner electrical contact 20 to electrically connect the inner electrical contact 20 of the electrical connector 10 to the inner electrical conductor 24 of the coaxial cable 14. The inner electrical contact 20 may have any suitable size, shape, geometry, and/or the like, and may engage the exposed portion of the inner electrical conductor 24 in any suitable configuration, arrangement, using any suitable structure and/or means, and/or the like. In the exemplary embodiment, the insulating member 18 includes an opening 104 that receives at least a portion of the exposed portion of the inner electrical conductor 24 therein. The exemplary embodiment of the inner electrical contact 20 includes an opening 108, shown in FIG. 7, at one end portion 110 thereof. The opening 104 extends through the insulating member 18 to the inner electrical contact 20 such that the opening 104 communicates with the opening 108 of the inner electrical contact 20. The exposed portion of the inner electrical conductor 24 extends through the opening 104 and is received within the opening 108 such that the inner electrical conductor 24 engages, and is thereby electrically connected to, the inner electrical contact 20. In an exemplary alternative embodiment, the inner electrical contact 20 includes a first extension (not shown) that extends from the end portion 110 through the opening 104 of the insulating member 18 toward the cable-receiving end portion 42. In such an alternative embodiment, the exposed portion of inner electrical conductor 24 is clamped between the first extension and a second extension (not shown; the second extension may extend from the end portion 110 or a free end portion of the first extension) to electrically connect the inner electrical conductor 24 to the inner electrical contact 20.

The coaxial cable end 12 engages the base 46 of the housing 16 and the cover tabs 82 and 84 are wrapped around a portion of the insulating cover 30 and crimped such that inner surfaces 112 and 114, respectively, of the cover tabs 82 and 84 engage the insulating cover 30 to facilitate securing the coaxial cable 14 to the electrical connector 10, as shown in FIG. 1. The exposed portion of the outer electrical conductor 28 engages the base 46 at the quadrant 38 (FIG. 2) of the circumference 32 (FIG. 2) of the outer electrical conductor 28 to electrically connect the outer electrical conductor 28 to the housing 16 and thereby the outer electrical contact 22. As used herein, engagement "at" a quadrant includes engagement with the entirety or only a portion of the quadrant. The extensions 70 and 72 each engage the outer electrical conductor 28 at the quadrants 40 and 36 (FIG. 2), respectively, of the circumference 32 of the outer electrical conductor 28, which are opposite each other and are each adjacent to the quadrants 34 and 38 (FIG. 2). The engagement between the extensions 70 and 72 and the outer electrical conductor 28 electrically connects the outer electrical conductor 28 to the housing 16 and thereby the outer electrical contact 22. The wedge-shape formed by the angle between the extensions 70 and 72 may facilitate holding the exposed portion of the outer electrical conductor 28 between the extensions 70 and 72.

The retention tabs 86 and 88 of the base 46 are wrapped around a portion of the extensions 70 and 72, respectively, and crimped such that inner surfaces 116 and 118, respectively, of the retention tabs 86 and 88 engage the extensions 70 and 72, respectively, to hold the extensions 70 and 72 between a portion of the retention tabs 86 and 88, respectively, and a portion of the base 46. The retention tabs 86 and 88 facilitate retaining the outer electrical contact 22 in the position with respect to the base 46 that is shown in FIGS. 1 and 4-8. The inner surfaces 116 and 118 of the retention tabs 86 and 88, respectively, engage the exposed portion of the outer electrical conductor 28 at the quadrant 34 of the circumference 32 of the outer electrical conductor 28, which is opposite the quadrant 38 and adjacent to the quadrants 36 and 40. The engagement between the retention tabs 86 and 88 and the outer electrical conductor 28 electrically connects the outer electrical conductor 28 to the housing 16 and thereby the outer electrical contact 22.

Figure 8:
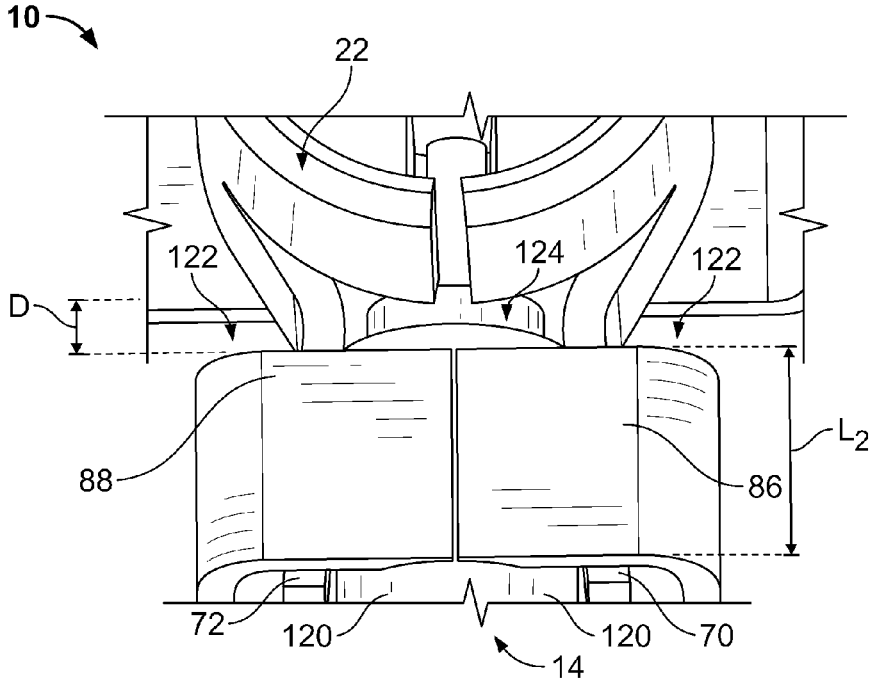
FIG. 8 is a perspective view of a portion of the electrical connector and coaxial cable shown in FIG. 1.

Referring now to FIGS. 1, 2, and 8, the engagement of the base 46, the extensions 70 and 72, and the retention tabs 86 and 88 facilitate providing protection for EMI emissions about the entirety of the circumference 32 of the outer electrical conductor 28 for the portion of the outer electrical conductor 28 that extends along a length $L_2$ of the retention tabs 86 and 88. The length $L_2$ of the retention tabs 86 and 88 extends between a pair of opposite end portions 120 and 122 of the retention tabs 86 and 88. As can be seen in FIG. 8, a portion 124 of the circumference 32 of the outer electrical conductor 28 that extends along a distance D defined between the outer electrical contact 22 and the end portion 122 of the retention tabs 86 and 88 is exposed. However, the remainder of the circumference 32 of the outer electrical conductor 28 that extends along the distance D is shielded by the extensions 70 and 72 and the base 46. The exposed portion 124 of the circumference 32 of the outer electrical conductor 28 that extends long the distance D may include only a portion of the quadrant 34, all of the quadrant 34, or the entire quadrant 34 and a portion of the quadrants 36 and/or 40.

Referring now to FIG. 1, the outer electrical contact 22 of the housing 16 may optionally include a groove 126 extending within a radially outer surface 128 of the outer electrical contact 22 that cooperates with an extension (such as, but not limited to, the extension 330 shown in FIG. 10) of another electrical connector that is configured to mate with the electrical connector 10. Cooperation between the groove 126 and the extension creates a snap-fit connection that may facilitate holding the two electrical connectors together. Additionally or alternatively, the outer electrical contact 22 of the housing 16 may optionally include an extension (not shown) extending outwardly from the radially outer surface 128 that cooperates with a groove (not shown) of another electrical connector that is configured to mate with the electrical connector 10. Moreover, the outer electrical contact 22 of the housing 16 may alternatively include a groove (not shown) or an extension (not shown) extending on a radially inner surface of the outer electrical contact 22 that cooperates with a respective extension or groove of another electrical connector that is configured to mate with the electrical connector 10.

Figure 10:
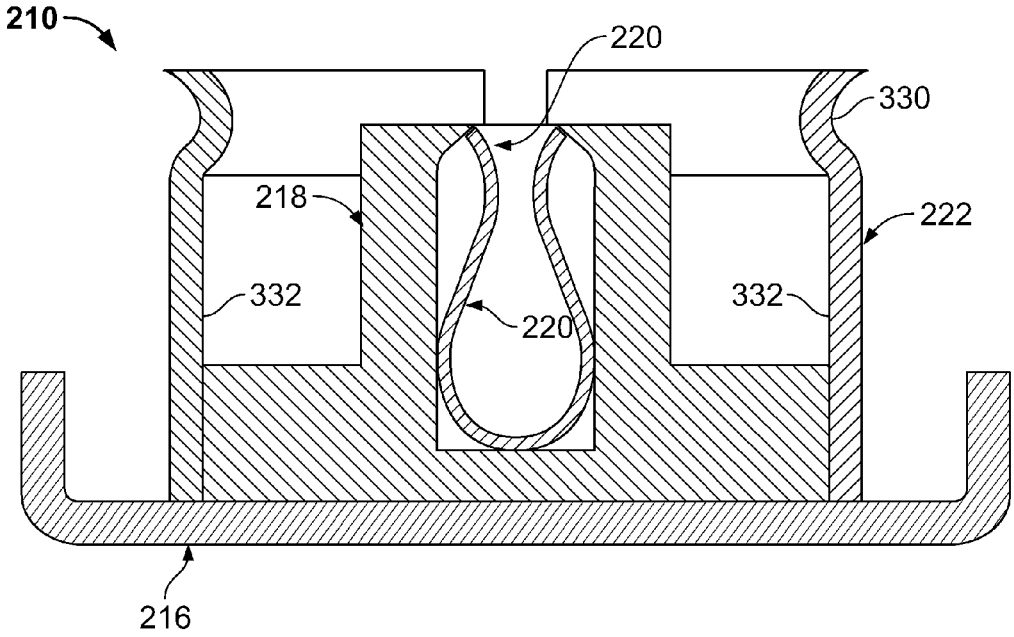
FIG. 10 is a cross-sectional view of the electrical connector shown in FIG. 9 taken along line 10-10 of FIG. 9.
Figure 9:
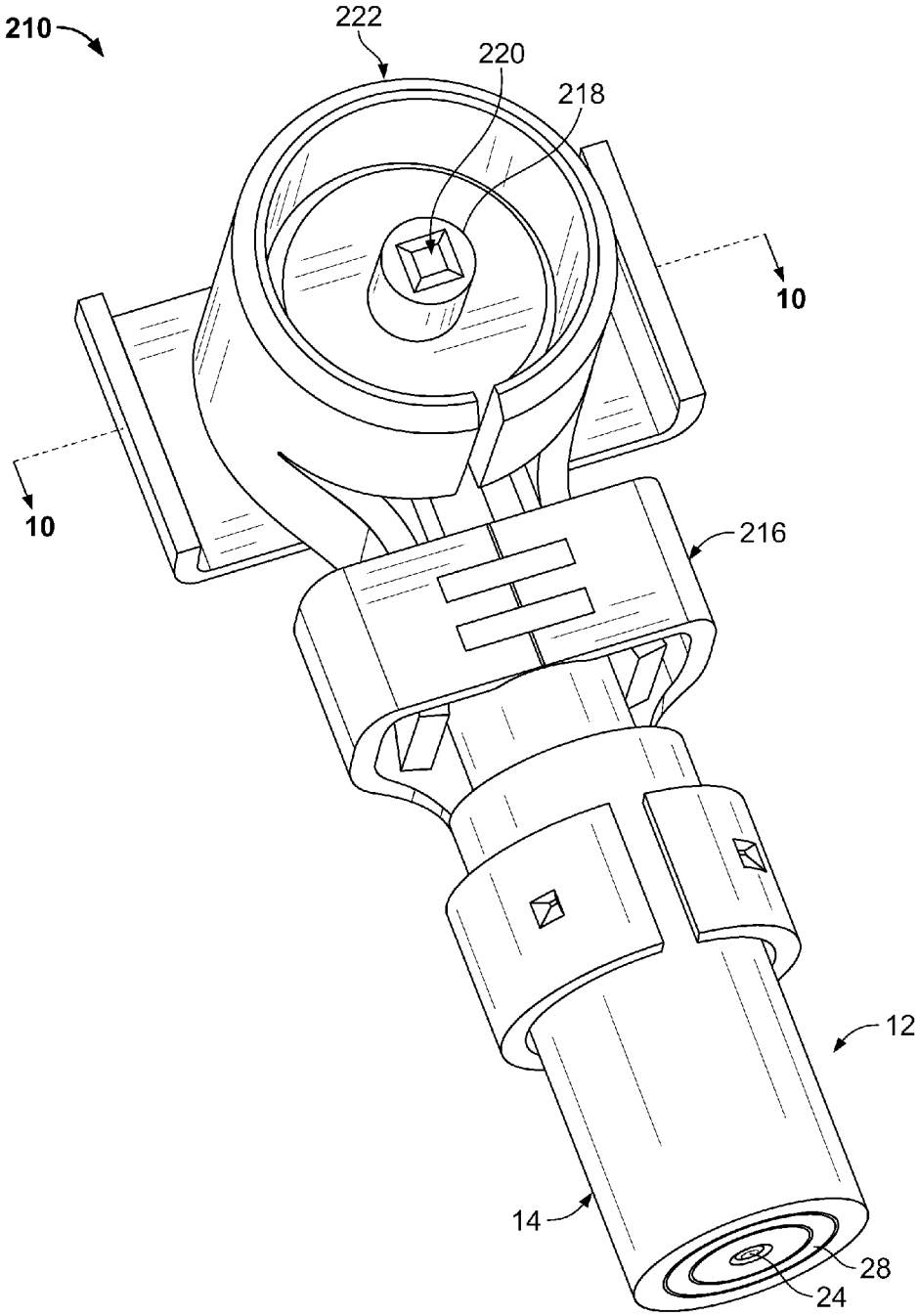
FIG. 9 is a perspective view of an exemplary alternative embodiment of an electrical connector illustrating the electrical connector terminating the end of a coaxial cable.

Although the electrical connector 10 is described and illustrated herein as including a plug contact 20 (FIGS. 1 and 5-7), the electrical connector 10 may alternatively include a receptacle contact. FIG. 9 is a perspective view of an exemplary alternative embodiment of an electrical connector 210 illustrating the electrical connector 210 terminating the end 12 of the coaxial cable 14. FIG. 10 is a cross-sectional view of the electrical connector 210 taken along line 10-10 of FIG. 9. The electrical connector 210 includes an electrically conductive housing 216, an insulating member 218 held by the housing 216, and an inner electrical contact 220 held by the insulating member 218. The housing 216 is electrically connected to the outer electrical conductor 28 of the coaxial cable 14, while the inner electrical contact 220 is electrically connected to the inner electrical conductor 24 of the coaxial cable 14. In contrast to the plug contact 20, the inner electrical contact 220 is a receptacle contact that is configured to receive a plug contact (such as, but not limited to, the plug contact 20) of another electrical connector (such as, but not limited to, the electrical connector 10) that is configured to mate with the electrical connector 210.

The outer electrical contact 222 of the housing 216 may optionally include an extension 330 extending outwardly from a radially inner surface 332 of the outer electrical contact 222 that cooperates with a groove (such as, but not limited to the groove 126 shown in FIG. 1) of another electrical connector that is configured to mate with the electrical connector 210. Cooperation between the extension 330 and the groove creates a snap-fit connection that may facilitate holding the two electrical connectors together. Additionally or alternatively, the outer electrical contact 222 of the housing 216 may optionally include a groove (not shown) extending within the radially inner surface 332 that cooperates with an extension (not shown) of another electrical connector that is configured to mate with the electrical connector 210. Moreover, the outer electrical contact 222 of the housing 216 may alternatively include a groove (not shown) or an extension (not shown) extending on a radially outer surface of the outer electrical contact 22 that cooperates with a respective extension or groove of another electrical connector that is configured to mate with the electrical connector 210.

With exception for the size, shape, geometry, and/or the like of the outer electrical contact 222, the housing 216 is substantially similar to the housing 16 (FIGS. 1 and 3-7) and therefore will not be described in more detail herein.

The embodiments described and/or illustrated herein provide a coaxial cable connector that may enable a coaxial cable to be terminated to the coaxial cable connector using fewer operations than at least some known coaxial cable connectors. For example, the embodiments described and/or illustrated herein provide a coaxial cable connector that may enable a coaxial cable to be terminated to the coaxial cable connector using less crimping operations. The embodiments described and/or illustrated herein provide a coaxial cable connector that may provide better EMI protection than at least some known coaxial cable connectors.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A housing for a coaxial cable connector that terminates a coaxial cable, wherein the coaxial cable includes a circumference having four quadrants, said housing comprising:

a cable-receiving end portion configured to engage an insulating cover of the coaxial cable;

a mating end portion configured to engage another coaxial connector;

a base extending between the cable-receiving end portion and the mating end portion, the base being configured to engage an outer electrical conductor of the coaxial cable at a first of the quadrants; and an electrical contact, the electrical contact comprising a first extension extending outwardly from the electrical contact and a second extension extending outwardly from the electrical contact, wherein the first extension is configured to engage the outer electrical conductor of the coaxial cable at a second of the quadrants that is adjacent the first quadrant, and wherein the second extension is configured to engage the outer electrical conductor at a third of the quadrants that is opposite the second quadrant.

2. The housing according to claim 1, wherein the first and second extensions extend away from each other as the first and second extensions extend outwardly from the electrical contact.

3. The housing according to claim 1, wherein the housing extends a length between the cable-receiving end portion and the mating end portion and along a longitudinal axis, the first extension extending outwardly from the electrical contact at an oblique angle with respect to the longitudinal axis.

4. The housing according to claim 1, wherein the electrical contact extends outwardly from the base at the mating end portion.

5. The housing according to claim 1, wherein the first and second extensions extend outwardly from the electrical contact at angle greater than 0° and less than 180° relative to each other.

6. The housing according to claim 1, further comprising a retention tab extending outwardly from the base, the retention tab being configured to wrap around a portion of the first extension such that the retention tab is configured to hold the first extension between a portion of the retention tab and a portion of the base.

7. The housing according to claim 1, wherein the housing further comprises a retention tab extending outwardly from the base, the retention tab being configured to engage the outer electrical conductor at a fourth of the quadrants, that is opposite the first quadrant.

8. The housing according to claim 1, wherein the electrical contact is an outer electrical contact of the coaxial cable connector, the coaxial cable connector including an inner electrical contact, the outer electrical contact defining a receptacle that is configured to at least partially contain the inner electrical contact.

9. An electrical connector for terminating a coaxial cable, wherein the coaxial cable includes a circumference having four quadrants, said electrical connector comprising:

an electrically conductive housing comprising:

a cable-receiving end portion configured to engage an insulating cover of the coaxial cable;

a mating end portion configured to engage another coaxial connector;

a base extending between the cable-receiving end portion and the mating end portion, the base being configured to engage an outer electrical conductor of the coaxial cable at a first of the quadrants;

an outer electrical contact, the outer electrical contact defining a receptacle and comprising an extension extending outwardly from the outer electrical contact, wherein the extension is configured to engage the outer electrical conductor of the coaxial cable at a second of the quadrants that is adjacent the first quadrant; and a retention tab extending outwardly from the base, the retention tab being configured to engage the outer electrical conductor at a third of the quadrants that is opposite the first quadrant;

an insulating member held by the housing at least partially within the receptacle defined by the outer electrical contact; and an inner electrical contact held by the insulating member.

10. The electrical connector according to claim 9, wherein the retention tab is integrally formed with the base.

11. The electrical connector according to claim 9, wherein the housing extends a length between the cable-receiving end portion and the mating end portion and along a longitudinal axis, the extension extending outwardly from the outer electrical contact at an oblique angle with respect to the longitudinal axis.

12. The electrical connector according to claim 9, wherein the retention tab is a first retention tab, the housing further comprising a second retention tab extending outwardly from the base and being configured to engage the third quadrant of the outer electrical conductor, the first and second retention tabs comprising end portions that are configured to oppose one another.

13. The electrical connector according to claim 9, wherein the extension is a first extension, the outer electrical contact comprising a second extension extending outwardly from the outer electrical contact, the second extension being configured to engage the outer electrical conductor at a fourth of the quadrants that is opposite the second quadrant.

14. The electrical connector according to claim 9, wherein the extension is a first extension, the outer electrical contact comprising a second extension extending outwardly from the outer electrical contact, wherein the first and second extensions extend outwardly from the outer electrical contact at an angle greater than 0° and less than 180° relative to each other.

15. The electrical connector according to claim 9, wherein the retention tab is configured to wrap around a portion of the extension such that the retention tab is configured to hold the extension between a portion of the retention tab and a portion of the base.

16. A housing for a coaxial cable connector that terminates a coaxial cable, said housing comprising:

a cable-receiving end portion configured to engage an insulating cover of the coaxial cable;

a mating end portion configured to engage another coaxial connector;

a base extending between the cable-receiving end portion and the mating end portion, the base being configured to engage a first quadrant of an outer electrical conductor of the coaxial cable;

an electrical contact extending outwardly from the base, the electrical contact comprising an extension; and a retention tab integrally formed with the base and extending outwardly from the base, the retention tab being configured to wrap around a portion of the extension such that the retention tab is configured to hold the extension between a portion of the retention tab and a portion of the base, wherein the retention tab is configured to engage a second quadrant of the outer electrical conductor of the coaxial cable that is opposite the first quadrant.

17. The housing according to claim 16, wherein extension of the electrical contact is configured to engage a third quadrant of the outer electrical conductor of the coaxial cable that is adjacent the second quadrant.

* * * * *